US008439023B2

(12) United States Patent
Lindenthal et al.

(10) Patent No.: US 8,439,023 B2
(45) Date of Patent: May 14, 2013

(54) IGNITION COIL, IN PARTICULAR FOR AN INTERNAL COMBUSTION ENGINE OF A MOTOR VEHICLE

(75) Inventors: Konstantin Lindenthal, Blaichach (DE); Johannes Kappeler, Oberstdorf (DE); Holger Raaf, Immenstadt (DE); Thomas Breckle, Bihlerdorf (DE)

(73) Assignee: Robert Bosch GmbH, Stuttgart (DE)

( * ) Notice: Subject to any disclaimer, the term of this patent is extended or adjusted under 35 U.S.C. 154(b) by 1138 days.

(21) Appl. No.: 12/299,279

(22) PCT Filed: Apr. 5, 2007

(86) PCT No.: PCT/EP2007/053371

§ 371 (c)(1),
(2), (4) Date: Feb. 2, 2009

(87) PCT Pub. No.: WO2007/125008

PCT Pub. Date: Nov. 8, 2007

(65) Prior Publication Data

US 2009/0301450 A1 Dec. 10, 2009

(30) Foreign Application Priority Data

May 2, 2006 (DE) ..... 10 2006 020 170

(51) Int. Cl.
*H01F 38/12* (2006.01)
*H01F 27/30* (2006.01)
*H01F 27/28* (2006.01)

(52) U.S. Cl.
USPC ..... 123/634; 336/199; 336/225

(58) Field of Classification Search ..... 123/169 P, 123/169 PA, 169 R, 143 C, 634, 635; 336/90, 336/92, 96, 198, 208; 439/125–128
See application file for complete search history.

(56) References Cited

U.S. PATENT DOCUMENTS 3,716,038 A * 2/1973 Bevacqua ..... 123/634
6,178,957 B1 * 1/2001 Widiger et al. ..... 123/634
6,522,232 B2 * 2/2003 Paul et al. ..... 336/96

(Continued)

FOREIGN PATENT DOCUMENTS

DE 38 30 763 3/1990
DE 102 51 840 5/2004

(Continued)

*Primary Examiner* — Mahmoud Gimie
*Assistant Examiner* — David Hamaoui
(74) *Attorney, Agent, or Firm* — Kenyon & Kenyon LLP

(57) ABSTRACT

An ignition coil, in particular for an internal combustion engine of a motor vehicle, having a secondary winding situated on a coil body for the production of a high voltage at a spark plug, having a contact sleeve that electrically contacts the secondary winding and that is capable of being pushed over an end area of the coil body and that has at least one contact element for the secondary winding, and having a holding-down element that can be pushed over the contact sleeve and that acts on the at least one contact element of the contact sleeve. In its end position, the holding-down element protrudes beyond the at least one contact element of the contact sleeve, seen in the axial direction of the coil body, and covers the at least one contact element.

6 Claims, 2 Drawing Sheets

U.S. PATENT DOCUMENTS

| | | | | |
|---|---|---|---|---|
| 6,747,540 | B1 * | 6/2004 | Nakase et al. | 336/192 |
| 6,857,420 | B2 * | 2/2005 | Weimert | 123/635 |
| 7,075,400 | B2 * | 7/2006 | Lerchenmueller et al. | 336/192 |
| 7,305,751 | B2 * | 12/2007 | Lerchenmueller et al. | 29/602.1 |
| 7,436,278 | B2 * | 10/2008 | Fischer et al. | 336/92 |
| 2003/0183214 | A1 | 10/2003 | Hiramatsu et al. | |
| 2005/0174206 | A1 | 8/2005 | Fujiyama | |

FOREIGN PATENT DOCUMENTS

| | | |
|---|---|---|
| JP | 2001-23840 | 1/2001 |
| JP | 2006-66881 | 3/2006 |
| WO | 2004/042748 | 5/2004 |
| WO | WO 2005/071700 | 8/2005 |

* cited by examiner

IGNITION COIL, IN PARTICULAR FOR AN INTERNAL COMBUSTION ENGINE OF A MOTOR VEHICLE

FIELD OF THE INVENTION

The present invention relates to an ignition coil, in particular for an internal combustion engine of a motor.

BACKGROUND INFORMATION

Such an ignition coil is discussed in German patent document DE 102 51 840 A1. In this ignition coil, the end region of a secondary coil body, together with a contact sleeve, is accommodated by a cup-shaped end segment of a high-voltage bolt (FIG. 4). Here, the high-voltage bolt extends up to a stop on the secondary coil body, which in turn also acts as a stop for the contact sleeve. In this way, the contact sleeve and the high-voltage bolt terminate in the same plane. After the assembly of the individual components, the ignition coil or ignition coil housing is filled with an insulating resin. Because, as a result of its formation as a stamped part, the contact sleeve has relatively sharp edges and corners, cracks can form starting at these areas during operation of the ignition coil, due to the differing coefficients of thermal expansion of the materials under changing temperatures. If the cracks extend over a larger area of the ignition coil housing, the danger arises that voltage sparkovers will occur that damage the functional capacity of the ignition coil.

SUMMARY OF THE INVENTION

In contrast, the ignition coil according to the present invention, in particular for an internal combustion engine of a motor vehicle, having the features described herein, has the advantage that the extension of cracks in case of thermal mechanical stress on the ignition coil is contained or limited. According to the present invention, this is essentially achieved in that the holding-down element surrounding the contact sleeve extends past or covers the contact sleeve in such a way that cracks going out from edges or corners of the contact sleeve terminate within the holding-down element, and are not permitted to extend beyond the holding-down element in the housing of the ignition coil.

Advantageous developments of the ignition coil according to the present invention, in particular for an internal combustion engine of a motor vehicle, are described herein.

An exemplary embodiment of the present invention is shown in the drawing and is explained in more detail below.

DETAILED DESCRIPTION

Figure 1:
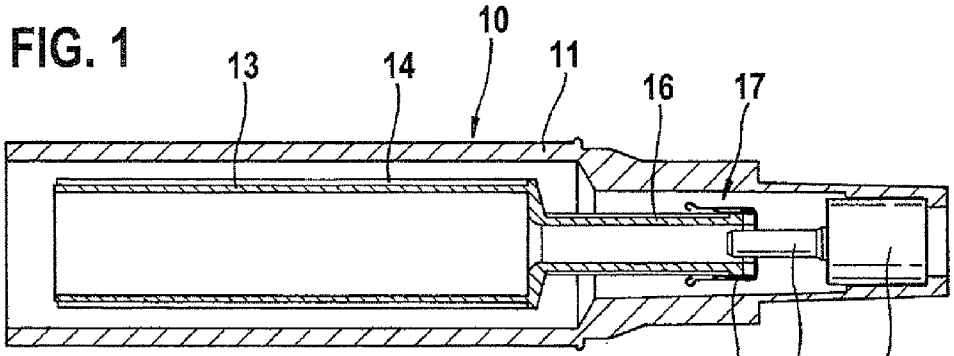
FIG. 1 shows a highly simplified longitudinal section through parts of an ignition coil.

FIG. 1 shows parts of an ignition coil 10 that is fashioned as a bar ignition coil. Ignition coil 10 has a housing 11 that is made of plastic and is essentially sleeve-shaped. In housing 11 there is situated, inter alia, a secondary coil body 13 having a secondary winding 14. Secondary winding 14, which carries high voltage, supplies the ignition energy for a spark plug (not shown) of an internal combustion engine. Secondary coil body 13 has a segment 16 that has a smaller diameter, on which the one end of secondary winding 14 that contacts the spark plug is also wound. A contact sleeve 18, made of an electrically conductive metal, is pushed over end area 17 of segment 16.

Figure 2:
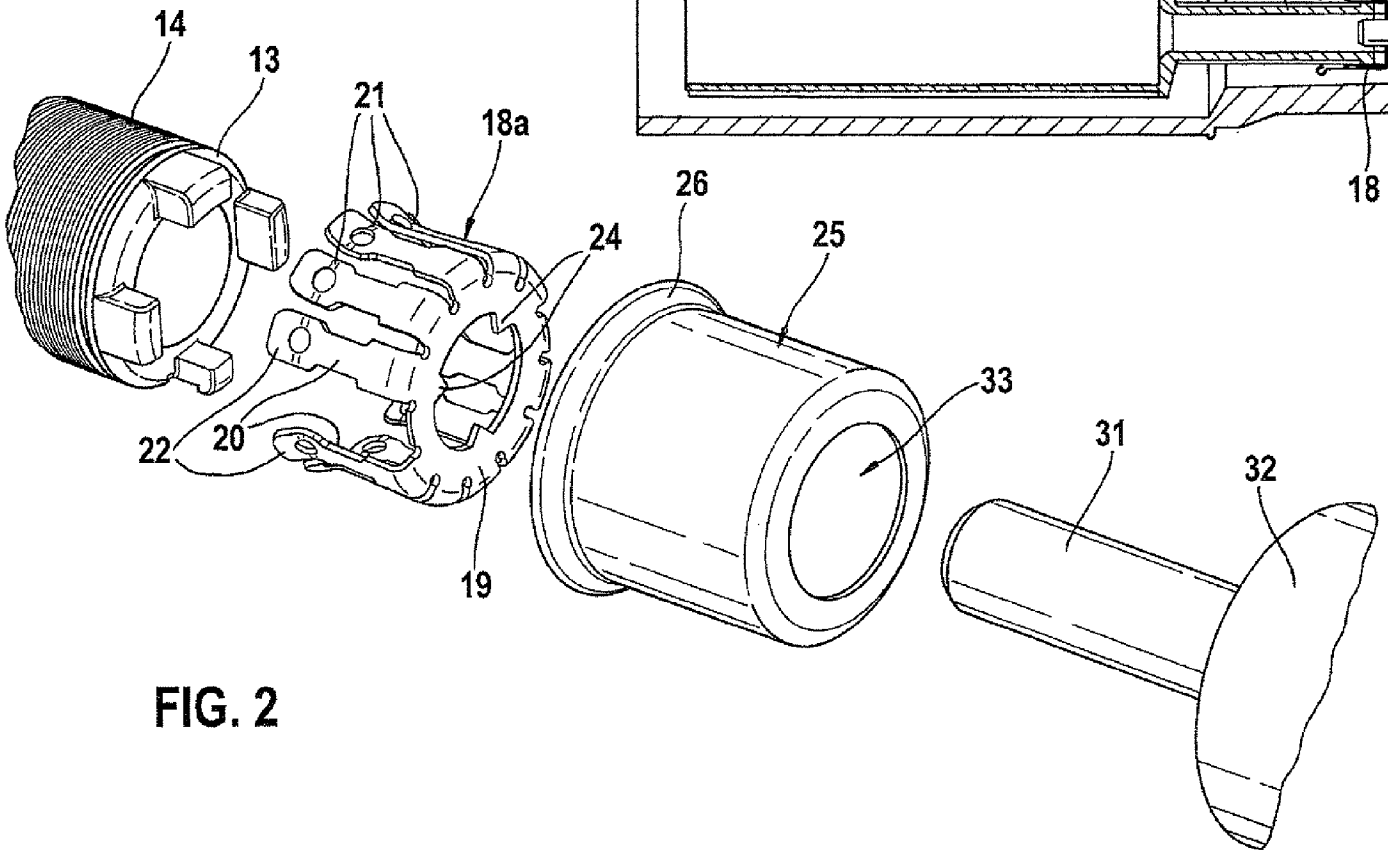
FIG. 2 shows components of the high-voltage-side terminal of the ignition coil of FIG. 1, in an exploded view.

As can best be seen in FIG. 2, contact sleeve 18 has a circular or annular region 19 from which bent contact clips 20 extend. Contact sleeve 18 is preferably produced using a stamping process, in which contact clips 20 are bent from area 19 after the stamping. On the side facing segment 16, contact clips 20 have contact areas 21 that, after contact sleeve 18 has been pushed onto end area 17 of secondary coil body 13, cover secondary winding 14 situated in segment 16. Contact clips 20 are bent somewhat outward radially on the side of contact areas 21 facing away from area 19, and these clips end in holding-down segments 22. From area 19 of contact sleeve 18, three triangular contact ribs 24 extend inward, situated at uniform angular distances in the exemplary embodiment.

Figure 3:
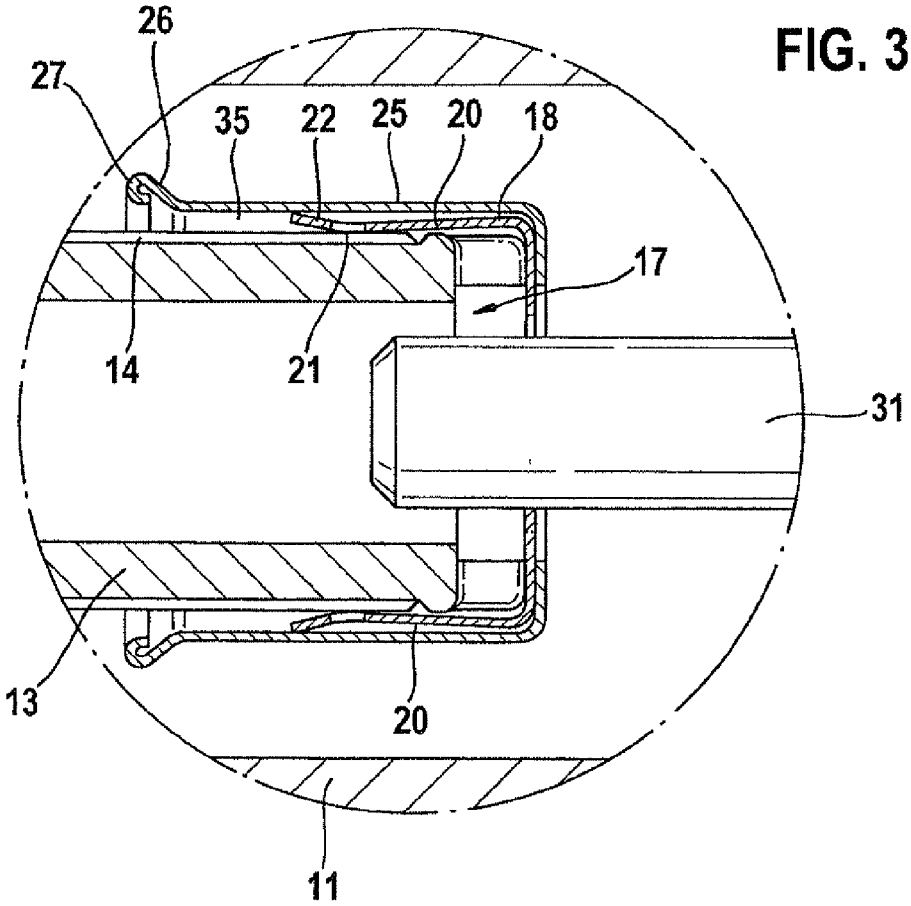
FIG. 3 shows the area of the high-voltage terminal in an enlarged longitudinal section.

A sleeve-shaped holding-down element 25 is capable of being pushed over contact sleeve 18. In the depicted exemplary embodiment, holding-down element 25 is produced from sheet metal using a non-cutting shaping process, and has on its side facing contact sleeve 18 an introduction area 26 that widens outward radially. In introduction area 26, the material of holding-down element 25 is beaded, so that a rounded run-in edge 27 results that does not have sharp corners or edges. It is essential that the length of holding-down element 25 be dimensioned such that when the end position of holding-down element 25 shown in FIG. 3 is reached, introduction area 26 is situated with its run-in edge 27 behind contact clips 20, seen in the direction of secondary coil body 13. In particular, contact clips 20 are not only covered by holding-down element 25, but holding-down element 25 extends beyond contact clips 20 by a particular length, for example one-third or one-half of the length of contact clips 20.

When holding-down element 25 is pushed onto contact sleeve 18, contact clips 20, which are at first still situated at a distance from secondary winding 14 if warranted, are pressed over holding-down segments 22 of contact clips 20 in the direction of secondary winding 14, through a corresponding dimensioning of the inner diameter of holding-down element 25, so that contact areas 21 abut secondary winding 14 so as to form an electrically conductive connection.

A pin-shaped interference-suppressing resistor 31 can be introduced into the sleeve-shaped end of end area 17 of secondary coil body 13. Interference-suppressing resistor 31 is integrally connected to a high-voltage terminal 32 that in turn electrically contacts the spark plug (not shown). The joining of interference-suppressing resistor 31 and secondary coil body 13 takes place while contact sleeve 18 and holding-down element 25 are mounted on secondary coil body 13. Interference-suppressing resistor 31 first passes through the one opening 33 of holding-down element 25, and then passes through annular area 19 of contact sleeve 18. Here it is essential that contact ribs 24 on area 19 of contact sleeve 18 are constructed such that contact ribs 24 come into effective connection with the periphery of interference-suppressing resistor 31, penetrating their external protective layer, so that an electrical connection is created between contact sleeve 18 and high-voltage terminal 32 via interference-suppressing resistor 31.

After the assembly of the components of ignition coil 10, housing 11 is filled with a hardening insulating resin that fills the spaces in the ignition coil 10, providing an electrical insulation between the voltage-conducting components. Inter alia, this insulating resin also fills the annular space 35 between holding-down element 25 and secondary coil body 13 (FIG. 3). Due to the stamping process, contact sleeve 18 normally has a large number of relatively sharp edges or corners, including contact clips 22. Under thermomechanical stress, there is a danger of cracks forming in the insulating resin starting from these areas. If these cracks extend between components that have different voltage levels, there is a danger of voltage sparkovers that adversely affect the functioning of ignition coil 10. Due to the fact that, according to the present invention, the jacket of holding-down element 25 covers contact clips 22, cracks in the insulating resin going out from contact clips 22 or from other areas of contact sleeve 18 terminate within holding-down element 25, without being able to extend beyond holding-down element 25 to other components. Due to the rounded shape of run-in edge 27 of holding-down element 25, there is also a relatively low danger of cracks from this area.

It is also to be noted that holding-down element 25 may be made not only of an electrically conductive or non-conductive metal, as in the exemplary embodiment, but may for example also be made of plastic.

Figure 4:
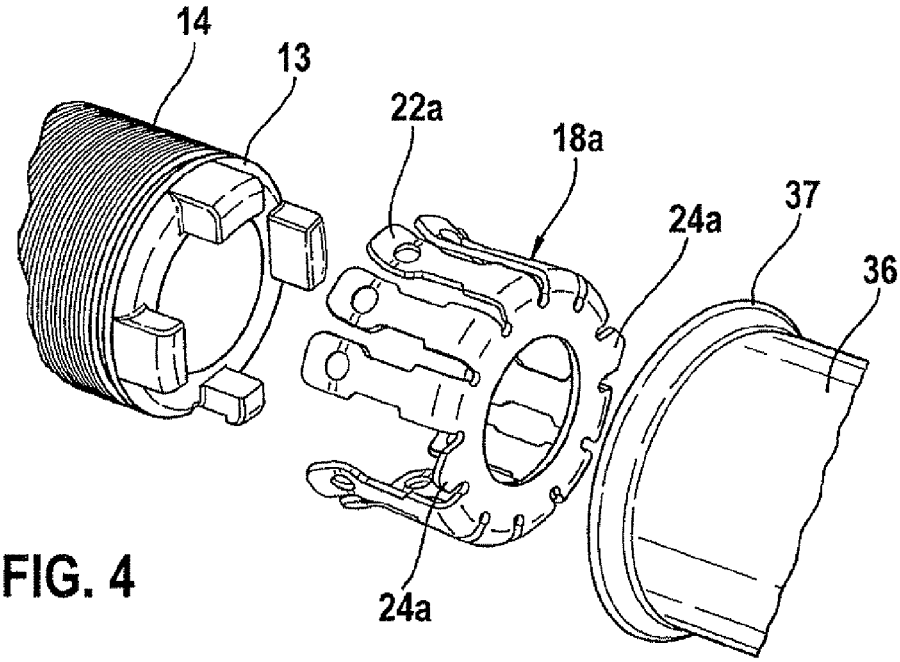
FIG. 4 shows an exploded view of a modified high-voltage-side terminal of the ignition coil.

In the modified exemplary embodiment of the present invention shown in FIG. 4, the holding-down element and the high-voltage terminal are fashioned as a combined, one-part component 36 made of conductive metal. In this case, pin-shaped interference-suppressing resistor 31 is omitted. Here, in order to bring about an electrical contacting of secondary winding 14 to component 36 and thus to the spark plug, on contact sleeve 18*a* there are provided contact ribs 24*a* that are situated on contact sleeve 18*a* so as to extend outward radially. In this case, the electrical connection is created such that when component 36 is pressed onto contact sleeve 18*a*, contact ribs 24*a* come into electrical contact with component 36 on its inner wall. However, according to the present invention, in this exemplary embodiment as well the length of component 36 is dimensioned such that its introductory area 37 covers contact clips 22*a* of contact sleeve 58*a* in the end position of component 36, preventing cracks in the insulating resin, going out from contact sleeve 18*a*, from extending beyond component 36.

What is claimed is:

1. An ignition coil, for an internal combustion engine of a motor vehicle, comprising:

a secondary winding situated on a coil body for producing a high voltage at a spark plug;

a contact sleeve having clip-type contacts that electrically contacts the secondary winding and that can be pushed over an end area of the coil body;

at least one contact element for the secondary winding;

a holding-down element that is capable of being pushed over the contact sleeve and that acts on the at least one contact element of the contact sleeve, wherein, seen in a longitudinal direction of the coil body, in its end position the holding-down element extends beyond the at least one contact element of the contact sleeve by one-third to one-half length of the at least one contact element and covers the at least one contact element.

2. The ignition coil of claim 1, wherein the holding-down element is rounded in its entry area on a side facing the coil body.

3. The ignition coil of claim 2, wherein the holding-down element is made of metal, and the entry area is beaded.

4. The ignition coil of claim 1, wherein the contact sleeve has at least one contact element that extends radially inward from an annular area of the contact sleeve, and the at least one contact element stands in an effective electrical connection with an interference-suppressing resistor which is in turn connected to a high-voltage terminal that is capable of being coupled to the spark plug.

5. The ignition coil of claim 1, wherein the holding-down element and a high-voltage terminal are fashioned as a combined one part component made of a conductive metal.

6. The ignition coil of claim 5, wherein the contact sleeve has at least one contact element that extends radially outward and that can be contacted electrically to the high-voltage terminal.

* * * * *

UNITED STATES PATENT AND TRADEMARK OFFICE

CERTIFICATE OF CORRECTION

PATENT NO. : 8,439,023 B2
APPLICATION NO. : 12/299279
DATED : May 14, 2013
INVENTOR(S) : Lindenthal et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1228 days.

Signed and Sealed this
Eighth Day of September, 2015

Michelle K. Lee

Michelle K. Lee
*Director of the United States Patent and Trademark Office*